US006431223B1

(12) United States Patent
Corain et al.

(10) Patent No.: US 6,431,223 B1
(45) Date of Patent: Aug. 13, 2002

(54) BRINGER GRIPPER FOR LOOMS WITHOUT SHUTTLES

(75) Inventors: Luciano Corain, Vicenza; Giulio Bortoli, Schio; Luigi Corazzola, Bolzano, all of (IT)

(73) Assignee: Sulzer Tessile Srl, Schio (IT)

( * ) Notice: Subject to any disclaimer, the term of this patent is extended or adjusted under 35 U.S.C. 154(b) by 0 days.

(21) Appl. No.: 09/831,989

(22) PCT Filed: Nov. 12, 1999

(86) PCT No.: PCT/IB99/01824

§ 371 (c)(1),
(2), (4) Date: May 15, 2001

(87) PCT Pub. No.: WO00/29651

PCT Pub. Date: May 25, 2000

(30) Foreign Application Priority Data

Nov. 17, 1998 (IT) ..... MI98A2487

(51) Int. Cl.[7] ..... D03D 47/23; D03D 47/38
(52) U.S. Cl. ..... 139/448
(58) Field of Search ..... 139/438, 448

(56) References Cited

U.S. PATENT DOCUMENTS 6,179,014 B1 * 1/2001 Shaw ..... 139/448

* cited by examiner

*Primary Examiner*—Andy Falik
(74) *Attorney, Agent, or Firm*—William Michael Hynes; Townsend and Townsend and Crew LLP

(57) ABSTRACT

A bringer gripper for looms without shuttles, where the weft yam is placed in an upper notch and in a gripping organ, particularly suitable for the simultaneous presentation of one or more wefts to the warp inlet and to the taker gripper, in which the upper notch is shaped with a multiple number of throats of different axial length. The weft yarns fit into the bottom of these throats and are essentially offset in the gripper's direction of motion.

13 Claims, 8 Drawing Sheets

BRINGER GRIPPER FOR LOOMS WITHOUT SHUTTLES

BACKGROUND OF THE INVENTION

This invention refers to a bringer gripper for the weft yarn in textile looms without shuttles.

More in detail, this invention refers to a gripper for the feeding of weft yarns to the grippers of looms without shuttles, suitable for processing multiple weft yarns at the same time, by presenting them at the warp inlet to the taker gripper, in an order controlled and predetermined in the delivery phase of the weft yarns.

This delivery occurs within a limited time and space interval, when the gripper moves into and pulls back from the cavity of the bringer gripper which has carried the weft yarns halfway into the warp inlet, picks up the weft yarns and completes their run to the opposite side.

To describe the technical problem faced by this invention in greater detail, along with the peculiar difficulties and requirements of the gripper-type looms, reference will now be made to the process of presenting the weft yarns in these looms, as shown in a simplified manner in FIGS. 1A and 1B.

FIG. 1A shows the fabric 1 already produced on the right side, and the warp inlet already opened in the two planes 2 and 3 by the motion of the heads, not shown in the figure for simplicity. In the warp inlet, at each of its openings and with the appropriate synchronization, one or more wefts must be inserted depending on the patterns of the fabric to be produced, and these wefts, or weft yarns, are delivered to a bringer gripper 4 moved inside the warp inlet by a lance of a semi-rigid ribbon 5, which wraps up and unwraps with an alternating rectilinear motion in the sense of the double arrow 6, as a result of the alternating rotary motion in the sense of the arrow 7 of the lateral driving wheels 8. In the most widely used looms the inserting of the weft yarn is done by a pair of grippers cooperating with each other: the bringer gripper and the taker gripper. They move by starting off from the two sides of the fabric and meet at the halfway line, where the bringer gripper 4, after picking up the yarn from the presenting device and completing its run over half the height of the fabric, delivers it to the taker gripper coming from the opposite side. After picking up the yarn, the taker gripper pulls back and completes its run over the remaining half of the fabric's height.

For further details on the taker grippers reference can be made to European patents Nos. 572.025 and 576.074, as well as to European patent application No. 95202072.5 by the same applicant. As a general principle, the bringer gripper is designed with a hollow front end where the weft yarns are presented to the taker gripper, which is in turn shaped like a hook capable, while advancing, of dipping into the hollow end of the bringer gripper and, while retracting, of gripping and carrying along these yarns, so as to complete their insertion into the warp pick.

After thus being introduced into the warp inlet, the weft yarn, or simply yarn, is inserted into the fabric by the motion of the reed, not shown in the figure for simplicity. In its alternating rectilinear motion the body of the bringer gripper 4 moves along the dotted horizontal trajectory 9.

The operation of presenting the weft yarn to the bringer gripper 4 occurs by presenting some rods 11 which receive their weft yarn 12 from their respective upstream reel. These presenting rods 11 are capable of moving between two places, an upper resting place and a lower delivering place for the respective weft yarn to the bringer gripper 4.

For the weft yarns' presenting devices, reference can be made to Italian patent applications Nos. MI97/A01821 and MI97/A01822 by the same applicant.

As known from the state of the art, the weft yarn is presented to the bringer gripper at an appropriate angle with respect to its trajectory 9. More precisely, the various weft yarns are presented according to a certain range of directions lying in a plane, always at a sharper or softer angle with respect to the direction 9 of the forward motion of the bringer gripper 4. In its forward motion the bringer gripper, while on its way into the warp inlet, successively crosses the weft yarns' various directions available, first those at a sharper and then those at a softer angle.

It must in fact be kept in mind that the bringer gripper is at the moment produced in a shape fitting the specific requirement of gripping only the yarns it encounters at a sharp angle, and of absolutely failing to grip the yarns it encounters at essentially less than sharp angles. This requirement conforms to the need that in case the warp inlet is not perfectly open and the warp yarn is not fully raised or lowered, the bringer gripper 4 must not grip and tear it, but only deflect it from its path, by raising or lowering it to the necessary place.

FIG. 1B gives an overall view of the situation after the yarn is gripped by the gripper 4 and after it has moved forward in the direction 9 toward the open warp inlet. Downstream of the yarn presenting and gripping place, a cutting organ 14, conventionally pictured here as a scissors, intercepts the weft section between the moving gripper 4 and the top of the warp inlet and cuts it, so that the weft yarn moved into the open warp inlet is that unrolled from its upstream reel and does not affect the yarn on the part of the fabric 1 which has already been produced. In fact, FIG. 1A shows the scissors in an open and FIG. 1B in a closed position, after cutting the yarn 12.

The technical problem of presenting the weft yarn turns more complex when two or more wefts are to be conveyed to the warp inlet simultaneously, by feeding them to the bringer gripper and delivering them from there to the taker gripper. These wefts may in fact turn out to be highly different in their dimensional characteristics and so on, or be presented at different stretching values or free lengths, so as to be consequently gripped with greater or lesser efficiency by the bringer grippers and taker grippers.

In consideration of the fact that the wefts are gripped and held firm by V-type notches and/or elastic organs, it proves to be most important for a good fabricating result that the introduction of the yarn hardest to retain in the bringer gripper occur in a controlled sequence between the yarns 12, as in its delivery to the taker gripper. It is generally preferable that the delivery of the most troublesome yarn to the taker gripper should take place first. If one keeps in mind, again as a general principle, that the taker grippers are shaped like hooks of a very sharp V-type form, it is preferable that the yarn most troublesome to hold enter the V-shaped recess first, and that the less troublesome yarn enter it thereafter.

SUMMARY OF THE INVENTION

The scope of this invention is to produce an advanced weft feeding device and processing system in gripper-operated looms, particularly in case of a simultaneous feeding of multiple wefts. The technical problem of enhancing the process of feeding the wefts to the textile process and the device governing this phase of the process in gripper-operated looms therefore essentially rests on the requirements of making two or more wefts available in differentiated and defined places in the bringer grippers, so as to present them in a pre-established sequence to the taker gripper, and that the latter may be able to pick them up in this sequence, as well as to control the motions of moving the mentioned wefts into the bringer gripper.

This invention consists of a device and a feeding process of the weft yarns into looms without shuttles, particularly suited to the simultaneous feeding of a multiple number of weft yarns to the textile process.

A bringer gripper for Jooms without shuttles is disclosed. The bringer gripper has a boxy parellelpiped hollow shape, built from a lower U-shaped bar and upper cover. The upper cover is fitted with a notch in which the weft yarn or weft is placed by the feeding reel, and in combination with a gripping organ is capable of capturing the weft on the part turned toward the fabric to present the weft to the taker gripper. The notch is shaped with a multiple number of throats of different axial lengths, so as to basically offset the weft yarns. The weft yarns come to rest at the bottom of each of the multiple throats in the direction of the axial motion of the gripper.

A method of presenting the weft yarns or wefts to a taker gripper of a loom without a shuttle equipped with a double gripper, and in particular for the double feeding of one or more wefts into the inlet of the warp, is disclosed. The wefts are arranged in the bringer gripper in a manner essentially offset in the direction of the axial motion of the grippers, and the wefts are presented to the taker gripper in the order of the offset arrangement. The order of presenting the wefts to the taker gripper is determined by the insertion of the wefts into the bringer gripper by placing them into a multiple number of throats of different axial lengths.

A platelet fitted with a projection having a rising profile on which the weft yarn is deflected into the bringer gripper is provided. This platelet is linked to the stationary structure of the machine and assists the introduction of the weft yarn into the bringer gripper. This linkage is adjustable in the direction of motion of the bringer gripper.

DESCRIPTION OF THE PREFERRED EMBODIMENTS

These figures show an embodiment of the invention in which two wefts are simultaneously inserted into the warp inlet, while noting that the invention may also be implemented for the simultaneous delivery of a larger number of weft yarns.

Figure 1A:
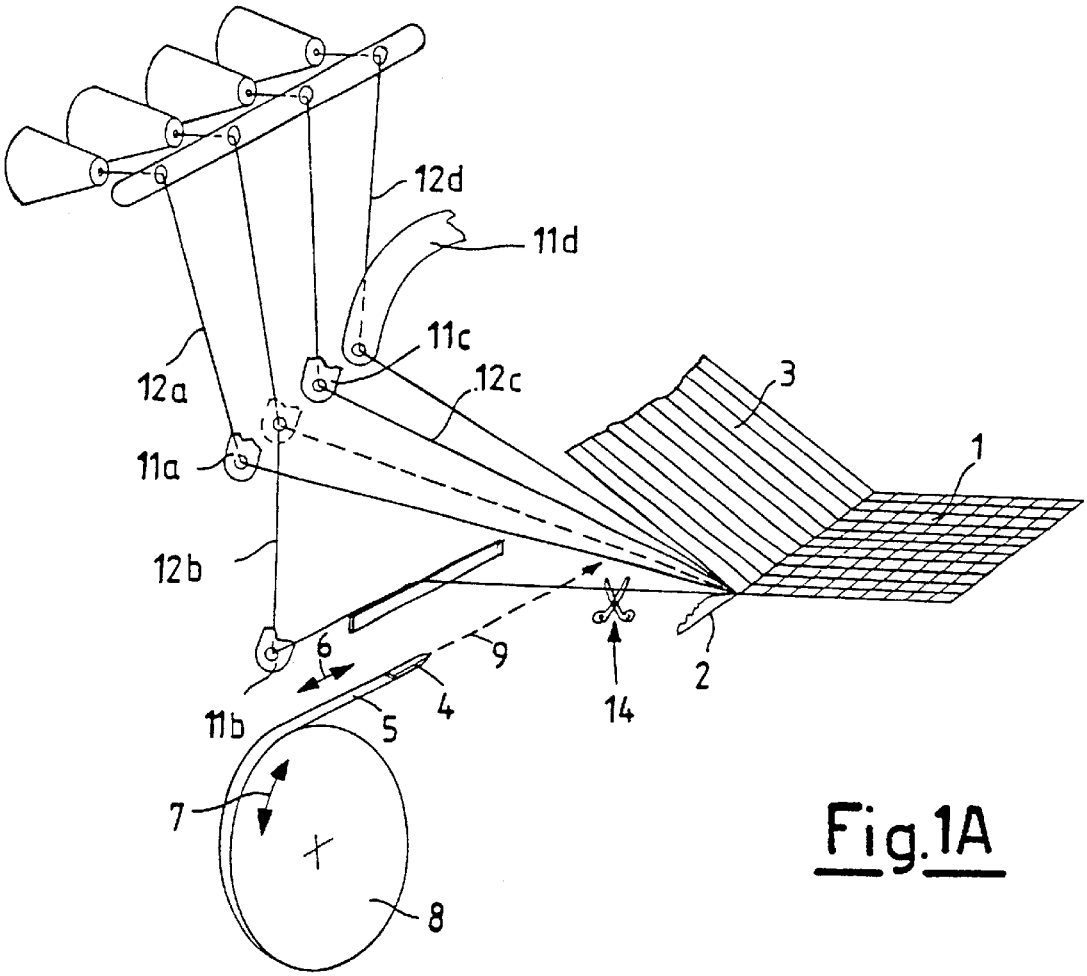
FIGS. 1A and 1B illustrate the technical problem in a general way.
Figure 1B:
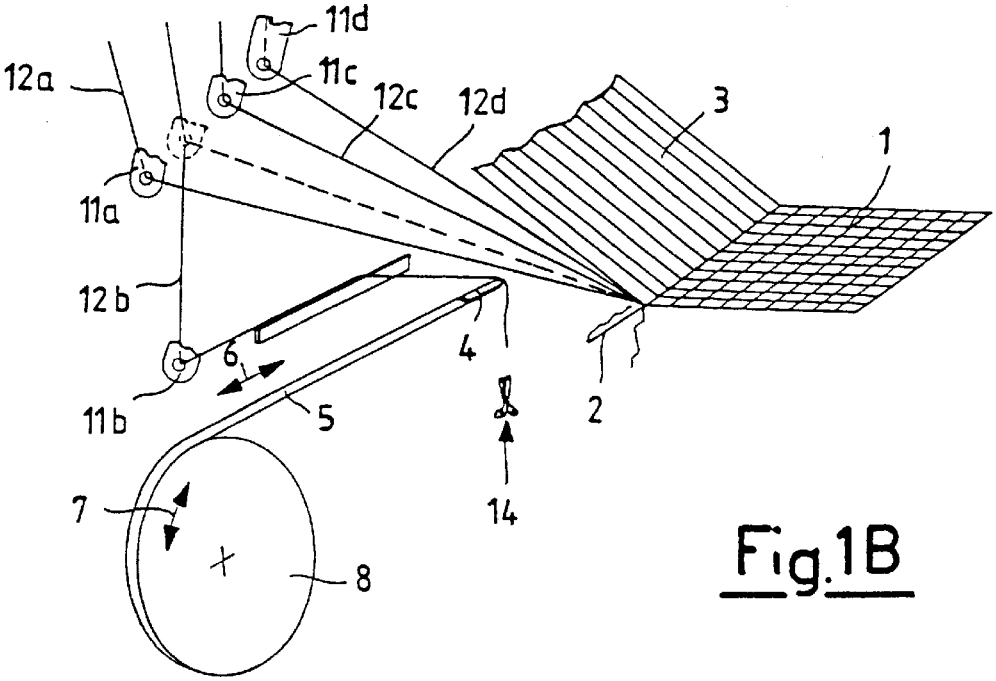
Figure 2:
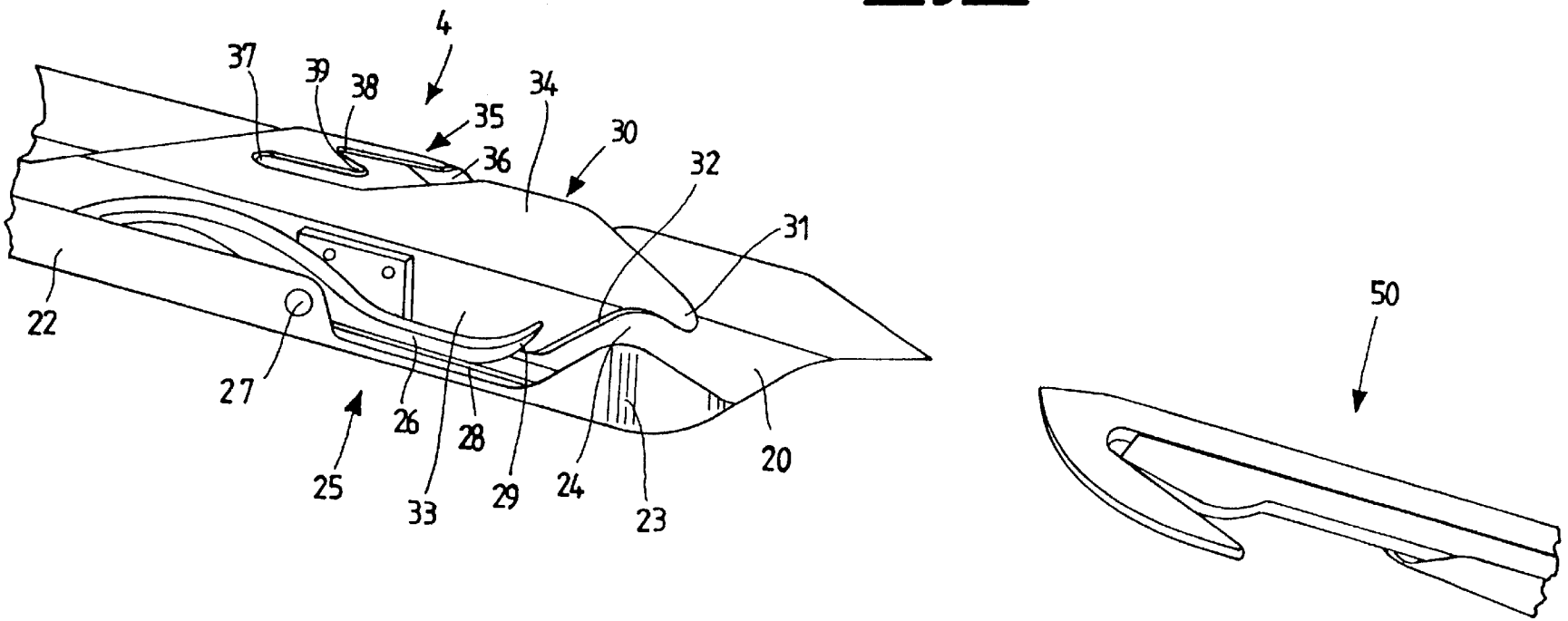
FIG. 2 offers a prospective overall view of the bringer gripper 4 according to the invention.

FIG. 2 shows the terminal portion of the bringer gripper 4 according to the invention in a prospective view. Its structure consists of a boxy, hollow parallelepiped form, produced from a profile bar 20 with a U-shaped cross section similar to that of the bringer grippers already known in the art, and by a cover 30 with an upturned L-shaped cross section. The tine 22 of the U-form on the observer's side has an initially slightly curved-in section, on which a profile 23 is mounted for the raising and lowering motion of the weft yarn 12, presented to the gripper 4 during the latter's forward motion from left to right, which forces the mentioned weft to pass it during its motion. This weft 12 is the one on the side connecting to the already produced fabric 1. The upper cover 30 in the shape of an upturned L is matched with a tip 31 that overlays and engages the weft yarn 12 and feeds it along the descending profile 32 applied on the vertical portion 33 of the upturned L and substantially held parallel to the profile 23 applied to the tine 22 of the U.

The cover's horizontal portion 34 is slightly narrower than the width of the underlying U-form. This generates a forced path 24 for the weft yarn 12 between the profiles 32 and 23, which is picked up by the gripper 4 and gradually lowered toward the base of the U.

A weft gripping organ 25 is placed at the end of the path 24, which is in itself already known in the art, for instance from U.S. Pat. No. 5,113,914 in the name of the same applicant. It may, again for exemplifying purposes, be implemented with a gripping extension 26 hinged in 27 and opposed to a part 28 of the underlying holder. The initial portion 29 of the gripping extension 26 is curved upward to invite the introduction of the weft 12 coming from the path 24 within a gradually narrowing recess. The gripping action of the weft on the part of the organ 25 may be achieved both by elastically actuating the extension 26, for instance by a spring, not shown in the figure for simplicity, which reacts to the insertion of the yarn and presses it between the extension 26 and the opposing part 28, as well as by the effect of the shape of the recess between these parts. The gripping organ 25 picks up the weft 12 on the part facing the fabric 1.

The upper face 34 of the cover 30 is essentially horizontal; it is provided with a placing notch for the weft yarn 12 on the side connecting to the feeding reels and passing through the presenting rods 11. This notch 35 is matched with a weft entrance passage 36, which has been picked up by the tip 31 and is with its opposite extremity running along the path 24; this notch continues upstream and offers the weft introduced below the cover 30 a path which splits up into two throats 37 and 38 separated by a rounded tip 39. The two throats 37 and 38 are made of a different axial length, so that the yarns coming to rest on the bottom of each are essentially offset in the direction (9) of the axial motion of the bringer gripper 4. The number 50 indicates the tip of the taker gripper to be described below. The shape of this notch 35 and its function in the overall design of the gripper is illustrated in the following figures. The embodiment pictured here for simplicity shows a notch 35 shaped with two throats 37 and 38, but as a general principle it may be shaped with a multiple number of throats of different axial depth, for instance with three or more.

Figure 3A:
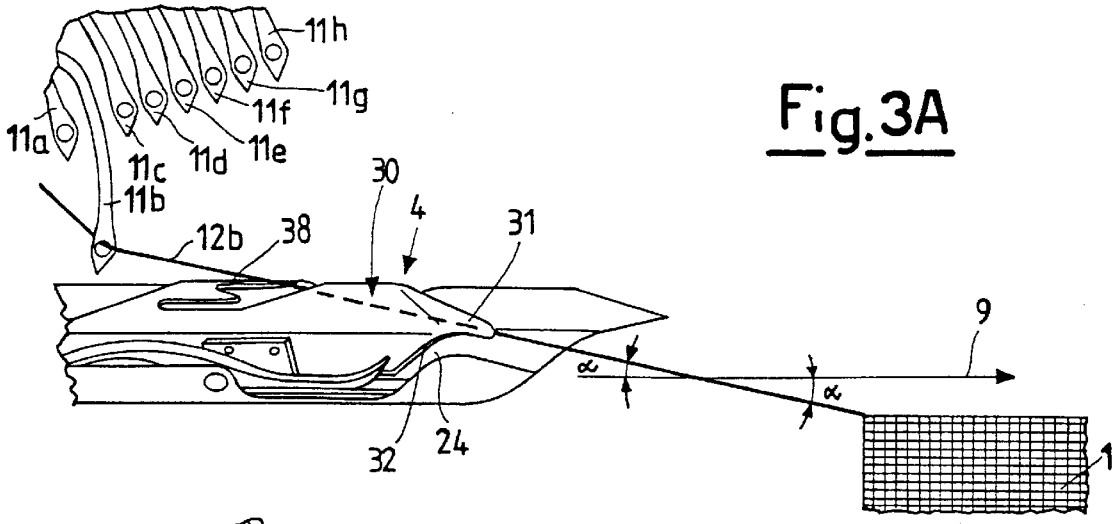
FIGS. 3A, B and C show a presenting and gripping sequence of the weft 12, as presented by the rods 11 placed at the outer left and at a tighter sharp angle.

FIGS. 3A, B and C illustrate the operation of the gripper in reference to the presenting and gripping sequence of the weft 12, as presented by the rods 11 placed to the outer left and at a tighter angle $\alpha$. The rods are indicated by the reference numbers from 11*a* to 11*h*, proceeding from the left to the right: the rods to the left 11*a*, . . . present their yarn 12*a*, . . . at a sharp angle a with respect to the direction of motion 9 of the gripper 4 which is narrower than that of the yarn of the rods 11*h*, . . . which present their yarn 12*h*, . . . at a sharper yet narrower angle $\alpha$.

Figure 3B:
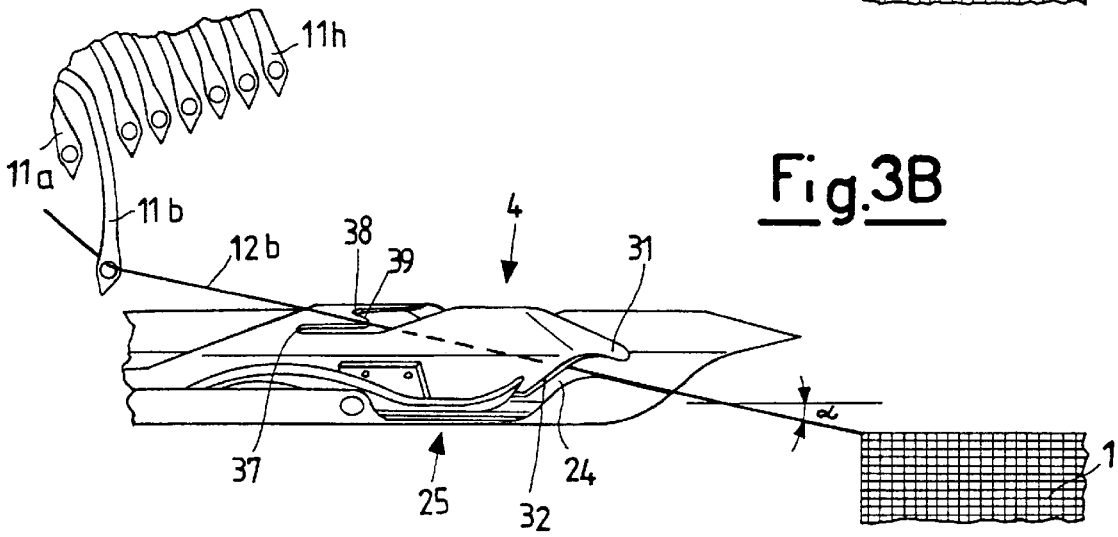
Figure 3C:
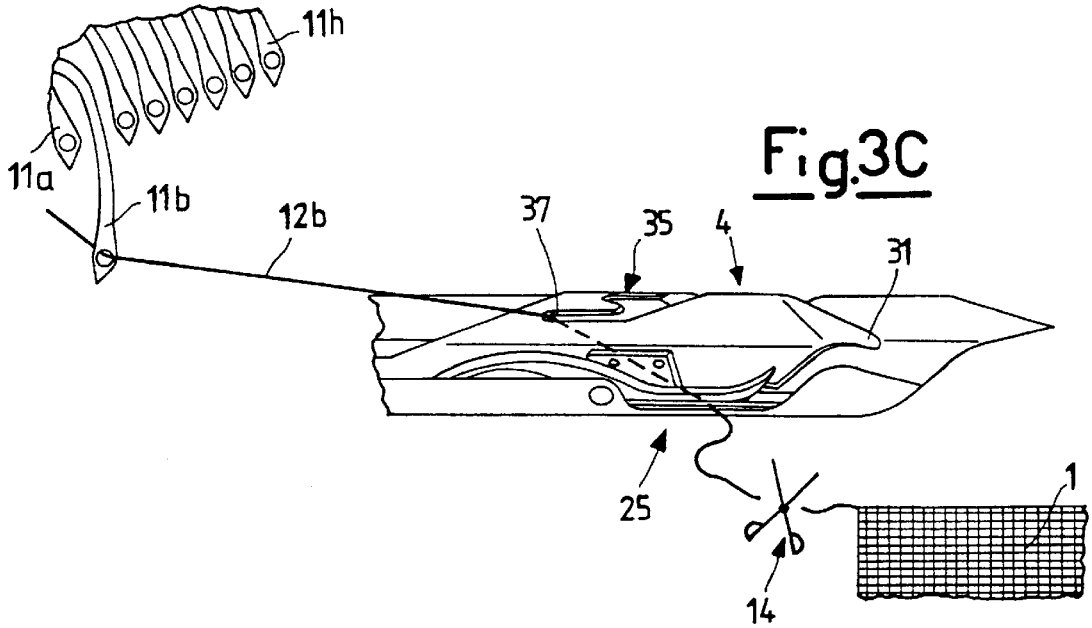

FIGS. 3A, B and C refer to the rod 11*b* which presents its yarn 12*b* to the gripper 4 while passing it in its forward motion in the direction 9. The yarn 12*b* is connected to the left to its reel, and to the right to the fabric 1. FIG. 3A shows weft yarn 12*b* presented by the lowered rod 11*b*; it is picked up by the tip 31 of the cover 30 and passed under the cover 30 by its intermediate portion. FIG. 3B shows the gripper 4 after it has moved forward with respect to its place in FIG. 3A; as a result of this motion the weft yarn 12*b* begins to follow the path 24 and in particular the descending profile 32, but has still dropped only little due to its very narrow angle a. On the other hand, the yarn 12*b* finds itself opposite the tip 39 and fails, due to its still insufficient lowering, to be picked up by the mentioned tip 39 in order to enter the throat 38, and continues its motion toward the bottom of the throat 37, where it stops as soon as it is picked up by the gripping organ 25. FIG. 3*c* shows the gripper 4 after it has moved still further to the right; as a result, the motion of the weft yarn 12*b* has completed its path 24, has been picked up by the gripping organ 25, and has been cut by the scissors 14 on the side of the fabric 1. On the other side the yarn is still connected to the upstream feeding reel and rests itself at the bottom of the throat 37. The particular shape of the notch 35 of the cover 30 thus induces the yarns presented first and with the narrowest angle to place themselves inside the throat 37 placed on the side closest to the gripping organ 25, or to the part closest to the fabric 1. The gripper 4 proceeds to the right and recovers some weft yarn from the reel, to convey it to the textile process. In the gripper 4 the yarn 12 finds itself, inside the parallelepiped box, constrained between the invitation to the throat 37 and picked up by the gripping organ 25, as shown by the dotted line.

Figure 4A:
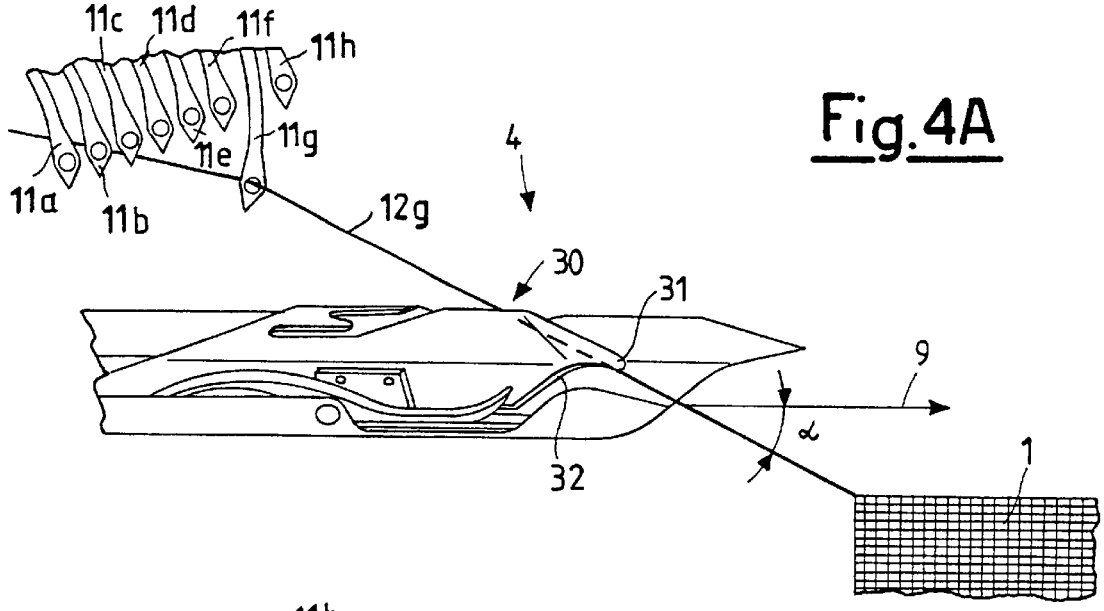
FIGS. 4A, B and C show a presenting and gripping sequence of the weft 12, as presented by the rods 11 sequence placed at the outer right and according to a softer sharp angle.
Figure 4B:
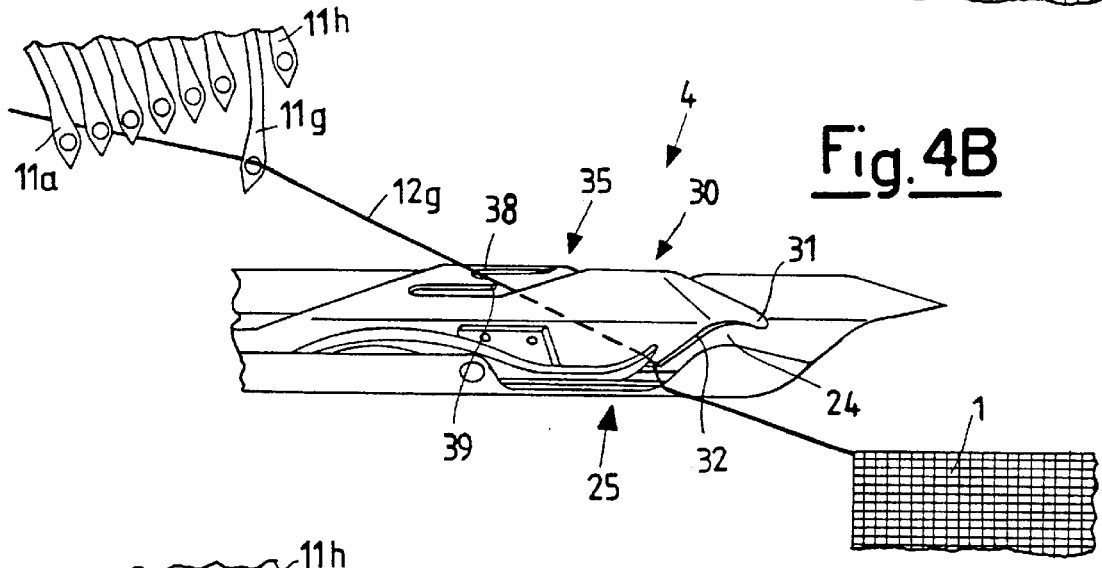
Figure 4C:
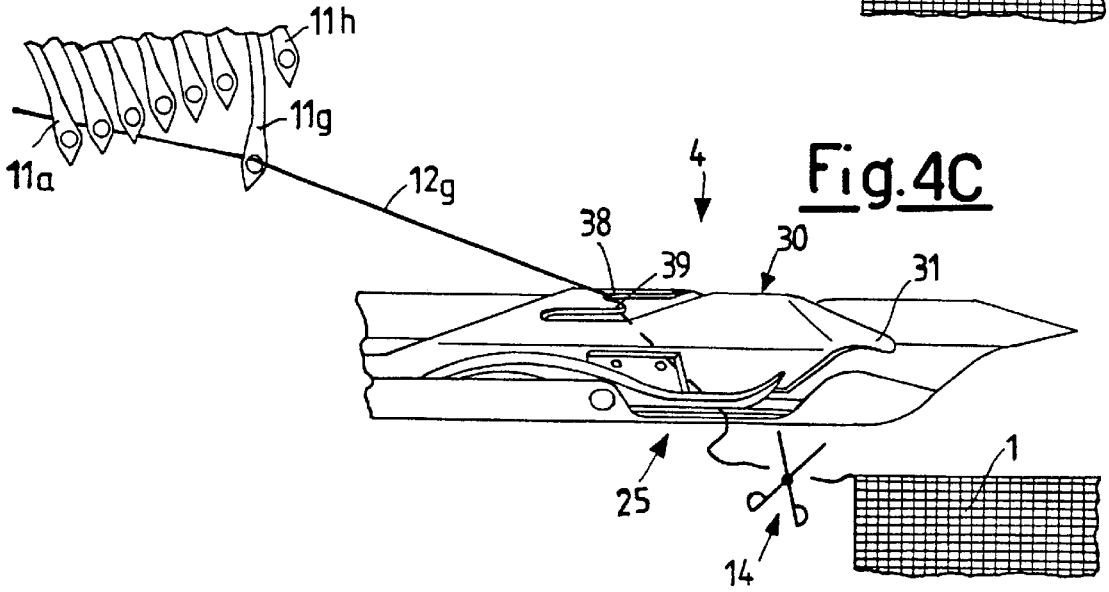

FIGS. 4A, B and C on the other hand refer to the rod 11*g*, which presents its yarn 12*g* to the bringer gripper 4 passing it during its forward motion in the direction 9. The yarn 12*g* is also connected to its reel on the left, and to the fabric 1 on the right. FIG. 4A shows that the weft yarn 12*g* is presented to the lowered rod 11*g*; in a manner similar to the former case, it is picked up by the tip 31 of the cover 30 and passed under the cover 30 by its intermediate portion. FIG. 4B shows the gripper 4 in an advanced place with respect to that of FIG. 4A; as a result of this motion the weft yarn 12*g* has followed the path 24 but has, due to its angle $\alpha$, also dropped almost completely. On the other side the yarn 12*g* running over the notch 35 has, when it meets the tip 39, already dropped sufficiently to be picked up by the mentioned tip 39 and enters the throat 38, where it will stop and be unable to proceed further toward the throat 37 as in the previous case. FIG. 4C shows, in a manner similar to the previous case, that the gripper 4 has further advanced to the right; as a result of this motion the weft yarn 12*g* has completed the path 24, has been picked up by the gripping organ 25, and has on the part of the fabric 1 been cut by the scissors 14. On the other side it is still connected to the upstream feeding reel and rests itself at the bottom of the throat 38. In this case the yarn 12 finds itself inside the parallelepiped box of the gripper 4 and constrained between the invitation of the throat 38 and the pick-up of the gripping organ 25, as shown in the dotted line, in a place differing from that in the case represented in FIG. 3C. The particular shape of the notch 35 of the cover 30 thus induces the yarns presented last and at the least narrow angle to the motion of the gripper 4 to rest themselves in the throat 38 set farthest away from the gripping organ 25, or on the side farthest away from the fabric 1.

From the foregoing description offered in reference to FIGS. 3 and 4 it is evident that it is the feeding path 24, and in particular the descending profile 32 of the wall 33, that determines the placing of the weft 12 in one of the throats 37, 38, depending on the angle a by which it is presented to the gripper 4.

Figure 5A:
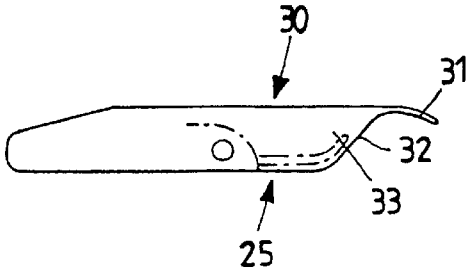
FIGS. 5A, B and C show details of the embodiment of the cover 30 of the gripper according to the invention.

FIGS. 5A, B and C illustrate two alternative embodiments of the cover 30.

FIG. 5A shows a side view of the vertical wall 33 of the cover 30, with the tip 31, the descending profile 32, and a part of the gripping organ 25: the side view fits both alternative embodiments.

Figure 5B:
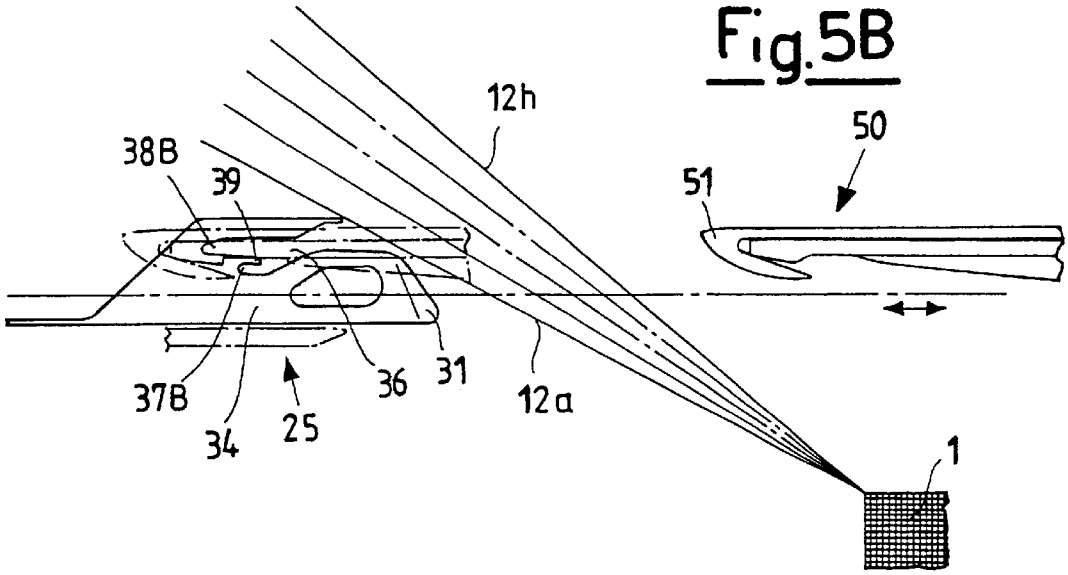

FIG. 5B shows a view of the upper wall 34 of the cover 30, in the alternative in which the throat 37B, closest to the gripping organ 25, is shaped with a lesser depth in an axial direction with respect to that of the throat 38B, which has a greater depth in an axial direction.

FIG. 5B also shows the taker gripper 50 in a highly simplified manner, while it moves in an alternating manner according to the double-pointed arrow, meeting the bringer gripper 4, introducing itself in its boxy part up to the place shown by a dashed line, and finally withdrawing from the same. The bringer gripper 4 and the taker gripper 50 share the direction of motion 9. In its forward motion, the convex portion of its terminal hook 51 pushes aside the yarns present in the boxy portion of the bringer gripper 4 and overtakes them. During the return motion of the taker gripper 50, the yarns 12 present in the boxy portion of the bringer gripper—placed in the throats 37, 38 and held firm by the gripping organ 25—are picked up by the hook 51 in the cavity which provides some gripping devices that pick up these yarns 12 from the bringer gripper 4 and carry them along to the remaining portion of the path in the open inlet of the warp, while continuing to call up some yarn from the reels placed upstream of their presenting rods 11.

As a general matter, the yarns entering the hook 51 first are picked up with greater efficiency, and there is consequently a need to present the hook 51 to all those yarns, first and in a well-separated manner, that turn out to be most difficult to grip, as already expected, due to some characteristics of their own or some presenting differences such as stretching, free length, braking, etc. The yarns picked up first by the taker gripper 50 are those placed inside the throat of greatest depth, meaning those extending farthest to the left in FIGS. 5A, B and C.

In the case of FIG. 5B, the yarns 12*a*, . . . , which are placed farthest to the left and encountered by the bringer gripper 4 first, come to a stop in the throat 37B, being the one with the smallest axial depth. These yarns 12*a*, . . . are therefore those that the taker gripper 50 will in its return path meet with its hook 51 in a later moment, while it will meet the yarns 12*h*, . . . first, which are placed farthest to the right and met by the grippers 4 further on. These have engaged inside the throat 38B, i.e. the one with the greatest axial depth.

In the case of the embodiment shown in FIG. 5B, the yarns which are difficult to pick up and grip effectively are placed in the adjacent rods farthest to the right 11*h*; on the contrary, the yarns which are easiest to pick up and grip are placed in the adjacent rods farthest to the left 11*a*. In the case of FIG. 5B, the wefts (12) presented to the bringer gripper (4) at a more open angle a are presented to the taker gripper (50) before those presented to the bringer gripper (4) at a tighter angle $\alpha$.

Figure 5C:
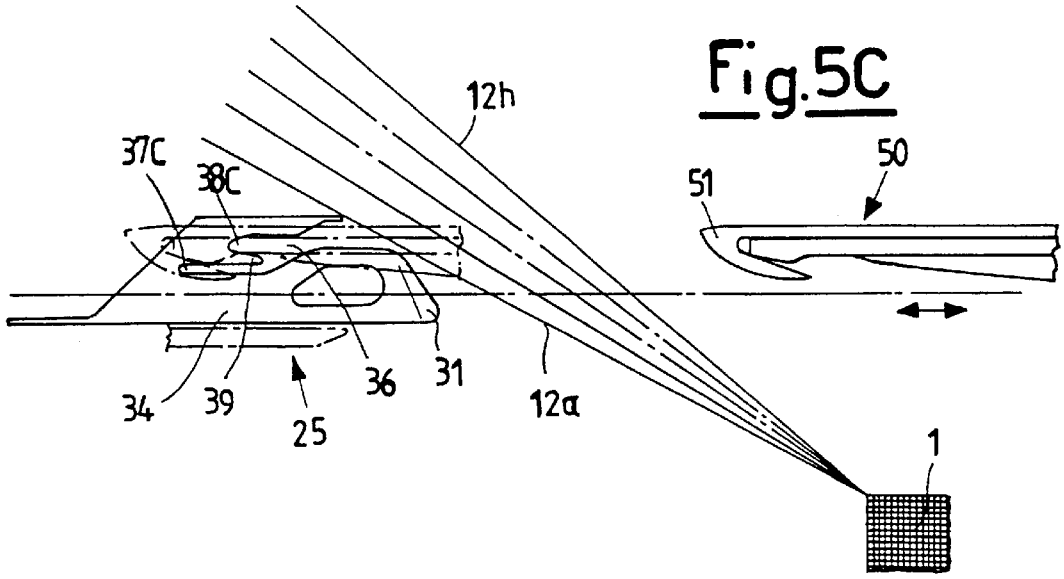

FIG. 5C shows a view of the upper wall 34 of the cover 30, in an alternative opposite to the previous one, in which the throat 37C closest to the gripping organ 25 is supplied with a greater axial depth with respect to the throat 38C having a lesser axial depth. FIG. 5C also gives a simplified view of the taker gripper 50, which moves as shown in FIG. 5B.

In the case of FIG. 5C, the yarns 12C, . . . , which are placed farthest to the left and met by the gripper 4 first, stop in the throat 37C having the greatest axial depth. These yarns 12*a*, . . . are therefore those that the taker gripper 50 will meet in its return motion with its hook 51 first, while it will meet the yarns 12*h*, . . . , i.e. those placed farthest to the right and meeting the bringer gripper 4 further on, in a second moment. These have come to engage in the throat 38C having a lesser axial depth.

In case of the embodiment shown in FIG. 5C, the technical solution is therefore the contrary of that in the previous case: the yarns most difficult to pick up and grip effectively are therefore placed in the adjacent rods farthest to the left 11*a*; the yarns easiest to pick up and grip are on the contrary placed in the adjacent rods farthest to the right 11*h*. In this case the wefts (12) presented to the bringer gripper (4) at a tighter angle a are presented to the taker gripper (50) before those presented to the bringer gripper (4) at a more open angle $\alpha$.

The axial depths of the two or more throats 37, 38 of the bringer gripper according to the invention, by which the yarns are presented to the taker gripper in a well-differentiated place, are appropriately differing from each other.

The reference to FIGS. 6, 7 and 8 describes embodiments of this invention marked by a still further refinement. This refinement refers to a case in which the yarns of the weft exhibit a different behavior while being inserted into the bringer gripper.

Figure 6A:
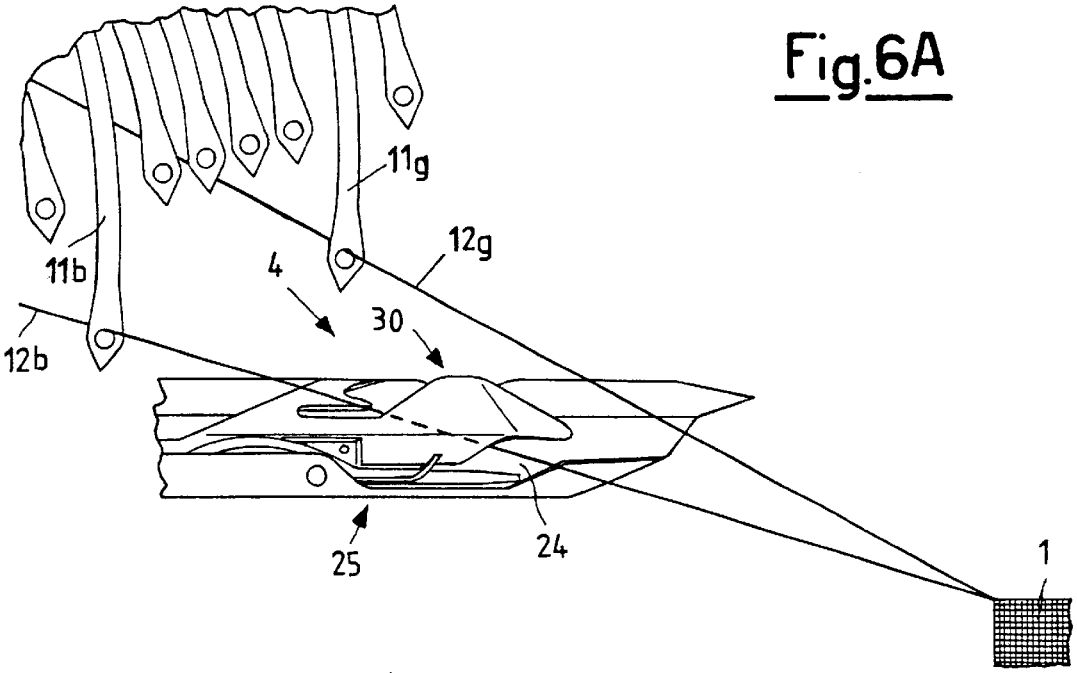
FIGS. 6A and 6B, 7A and 7B and 8A and 8B illustrate further developed embodiments of this invention.
Figure 6B:
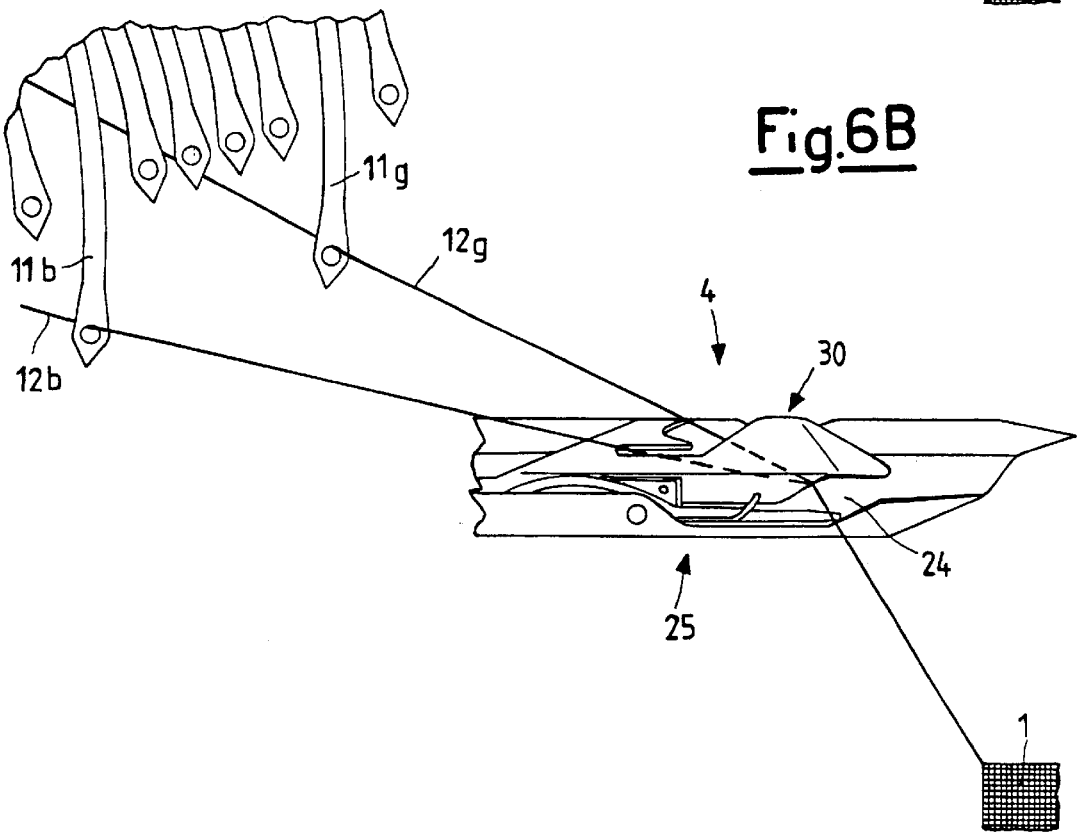

FIG. 6A shows two wefts 12*b*, g presented to the bringer gripper 4 by their rods 11*b, g*. Let us consider for example the case in which the weft 12*b*, met in its forward motion by the gripper 4 first, is because of any characteristics of its own or because of its manner of presentation, as mentioned above, marked by a more difficult forward sliding action under the cover 30 and inside the path 24, for instance because it is a thinner, more pliable and/or "hairier" yarn; it will thus move forward more slowly. The weft yarn 12*g* will on the other hand, still as an example, have such characteristics as to move forward in this path 24 more quickly, because it is a thicker, farther outstretched and less pliable yarn. The yarn 12*g* will consequently, as shown in FIG. 6B, move into the gripper 4 at a later moment, but may reach, push on, and even overtake the yarn 12*b*.

Owing to the fact that it is generally preferable that the yarns to be presented to the taker gripper 50 first should also be presented to the gripping organ 25 of the bringer gripper first, the behavior of the two wefts can be expected to be made more uniform by overcoming the reluctance of the upstream yarns, for example 12*b*, to move along the path 24 thanks to the following refinement.

This refinement consists in selectively interposing in the path of the weft yarns most difficult to run and to place farther upstream in their presentation, a fixed or controllable switch capable of modifying the presentation angle to the gripper while being inserted into the path 24, by making it softer and reducing the length of the uncontrolled stretch in the direction of the fabric 1.

Figure 7A:
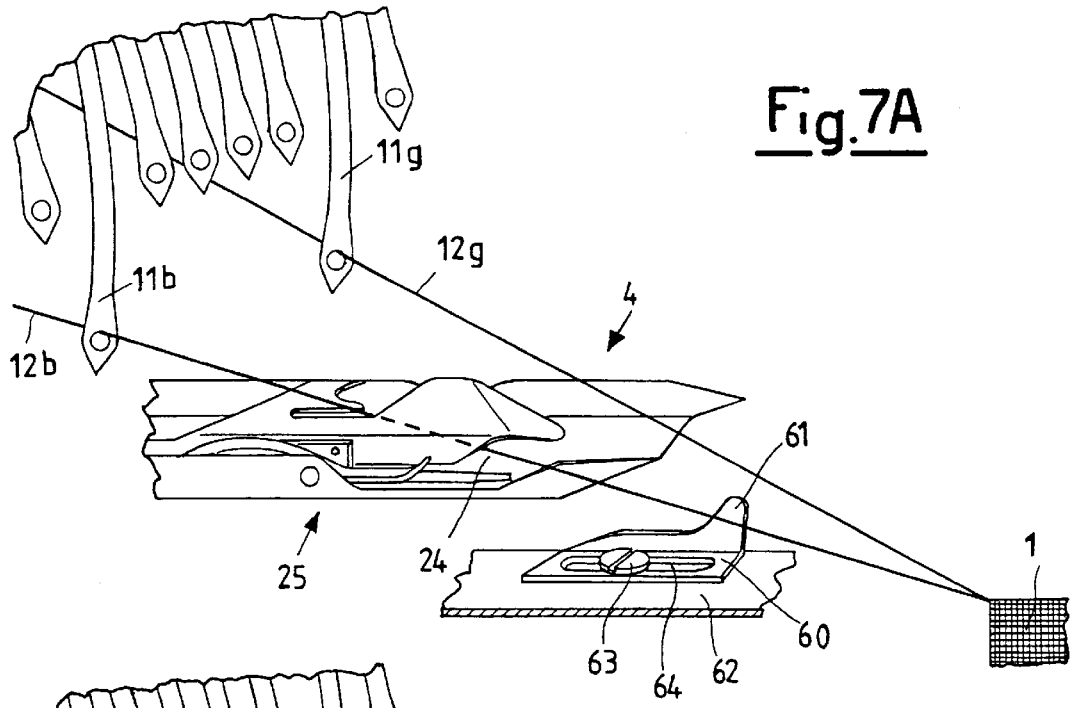
Figure 7B:
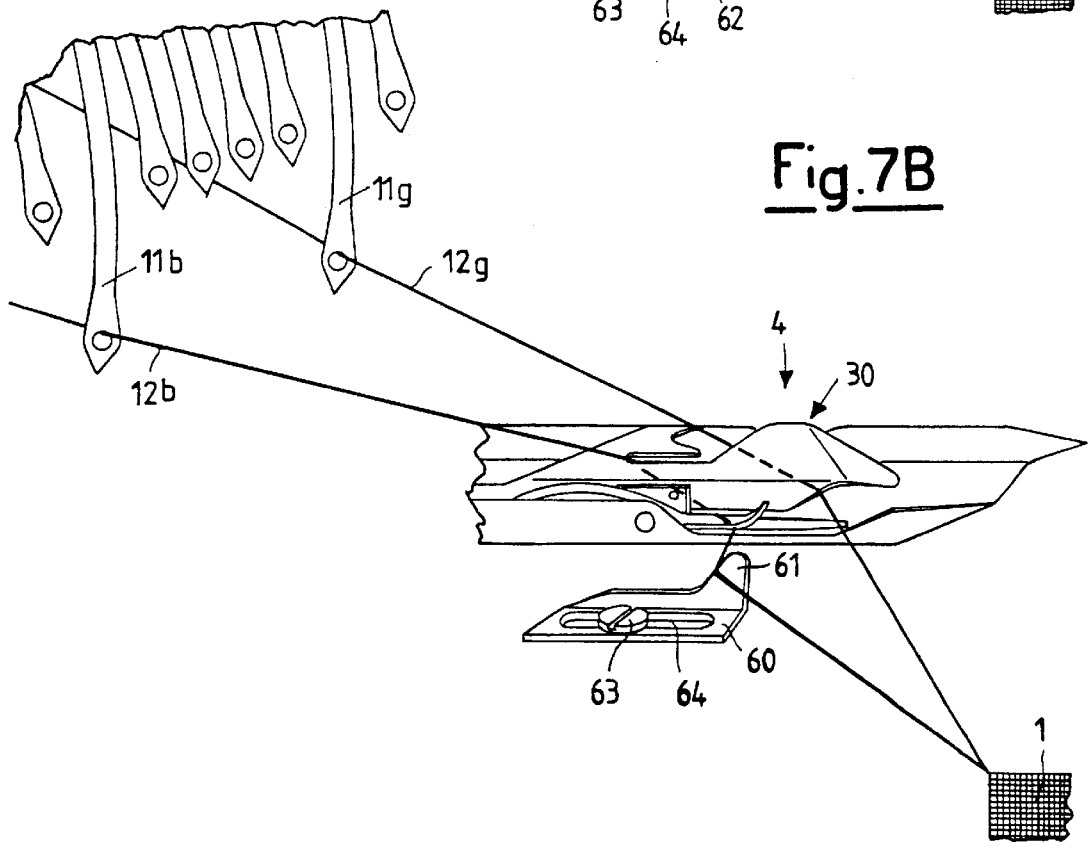

In the exemplifying yet non-limiting embodiment shown in FIGS. 7A and 7B this switch is fixed and illustrated as a platelet 60 fitted with a projection 61 having a profile rising from left to right, on which the affected weft yarn 12*b* is deflected. In this embodiment the platelet 60 is linked to the machine's stationary structure 62 by a linkage adjustable in the direction of motion of the gripper, by mounting it for example with a pressure screw 63 inside an eyelet 64, so as to vary the place of the platelet 60 in this direction and to deflect only a few of the yarns 11*a, b*, . . . farther upstream, which are the most difficult, and not also the other yarns 11*h, g*, . . . , which do not need it. FIG. 7B shows that the gripper 4 has moved forward and that the weft 12*b* is being intercepted by the rising profile 61: the weft moves up on it, enters the gripping organ 25 and then leaves it behind, after overtaking it. The weft yarn 12*g* farther downstream is on the contrary not affected, because the platelet 60 is adjusted so as to intercept only the yarns farthest upstream.

Figure 8A:
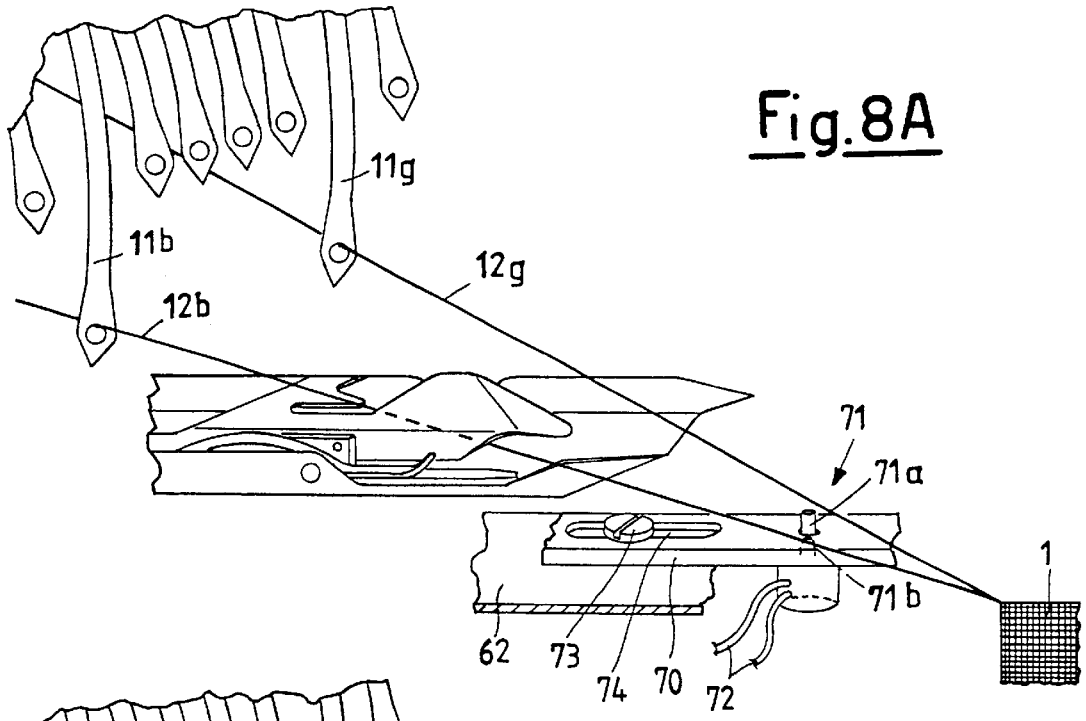
Figure 8B:
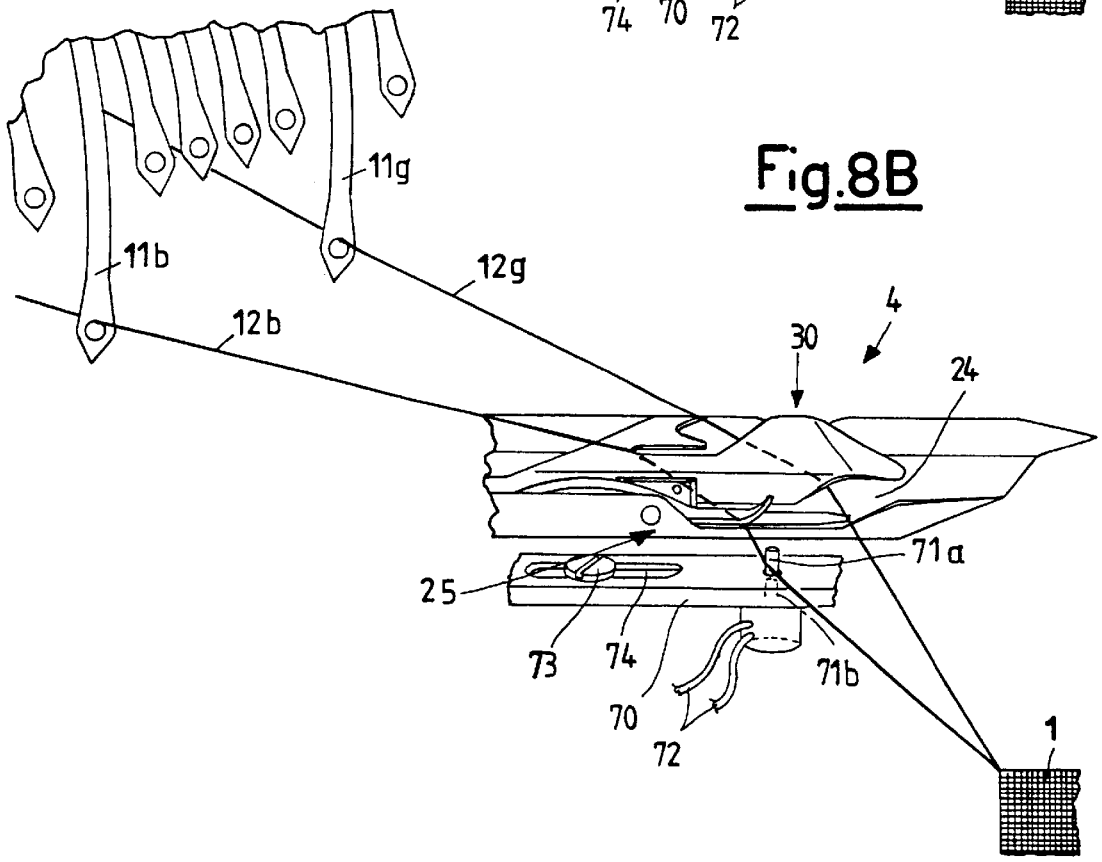

In the exemplifying yet non-limiting embodiment shown in FIGS. 8A and 8B this switch is controlled and illustrated as an electromagnetically actuated device 70 fitted with an element 71 controlled to rise and fall so as to intercept the weft and/or to release it in the desired time sequence.

The device 70 is also linked to the machine's structure 62 by an adjustable linkage, mounted for example with a pressure screw 73 in an eyelet 74, so as to be capable of acting on a variable number of the yarns 11*a, b*, . . . farther upstream, which are the most difficult, and not also on the other yarns 11*h, g*, . . . , which do not need it.

The device 7υ may be actuated to rise to a place 71*a* in a manner coordinated with the motion of the rods 11*a, b*, . . . which present the weft yarns 12*a, b*, . . . to be deflected by the same device. This makes it possible to vary the intervention of the switching device 70 to one or more weft yarns by acting on the control unit of the frame, whenever the fabric to be produced varies. The frame's control unit takes care of activating the device 70 with the aid of the small cables 72. FIG. 8B shows that the gripper 4 has moved forward and that the yarn 12*b* is being intercepted, switched by the raised element 71, and helped to enter the gripping organ 25. The weft 12*b* leaves the switch whenever the element 71 retracts, or after the weft has been cut by the scissors 14. The weft yarn 12*g* placed farther downstream is on the other hand left unswitched, because the device 70 is placed so as to affect only the yarns placed farther upstream.

What is claimed is:

1. A bringer gripper (4) having axial motion (9) for inserting a plurality of wefts (12) from feeding reels to a taker gripper (50) in looms without shuttles for weaving fabric (1), the loom including a plurality of rods (11*a*, . . . 11*h*) for presenting at least two wefts (12*a*, . . . 12*h*) into the path of axial motion (9) of the bringer gripper (4), the bringer gripper (4) comprising:

a hollow lower U-shaped bar (20);

an upper cover (30) fitted to the hollow lower U-shaped bar (20) so as to form a parallelepiped hollow shape;

a gripping organ (25) capable of capturing the wefts (12) on a part turned toward the fabric (1) to present said weft to a taker gripper (50); and, the upper cover (30) fitted with a notch (35) in which the wefts (12) are inserted, the notch (35) being shaped with a multiple number of throats (37, 38) offset with respect to the axial motion (9) of the bringer gripper (4), to offset the wefts (12) during insertion by coming to rest at the bottom of at least one of the multiple number of throats (37, 38) in the direction of axial motion (9), during the axial motion of the bringer gripper (4).

2. The bringer gripper (4) according to claim 1 wherein:

the throat (37) placed closest to the gripping organ (25) is made of a lesser axial depth with respect to the throat (38) placed on the side of the feeding reels.

3. The bringer gripper (4) according to claim 2 wherein:

the throat (37) placed closest to the gripping organ 25 is made of a greater axial depth with respect to the throat (38) placed on the side of the feeding reels.

4. The bringer gripper (4) according to claim 2 wherein:

the wefts (12) are each disposed along relatively angularly inclined feeding paths (24) with respect to the axial motion (9) of the bringer gripper (4) to place the wefts (12) into one of the throats (37, 38) responsive to the angularly inclined feeding path at which each weft (12) is presented to the bringer gripper (4).

5. A method of presenting a plurality of wefts (12*a*, . . . 12*h*) in a controlled sequence from a bringer gripper (4) having axial motion (9) to a taker gripper (50) of a loom without a shuttle equipped with a double gripper, comprising the steps of:

providing a plurality of rods (11*a*, . . . 11*h*) for presenting at least two wefts (12*a*, . . . 12*h*) into the path of axial motion (9) of the bringer gripper (4);

providing a bringer gripper (4) including:

a hollow lower U-shaped bar (20), an upper cover (30) fitted to the hollow lower U-shaped bar (20) so as to form a parallelepiped hollow shape, a gripping organ (25) capable of capturing the wefts (12) on a part turned toward a fabric (1) to present said weft to a taker gripper (50), and the upper cover (30) fitted with a notch (35) in which the wefts (12) are inserted, the notch (35) being shaped with a multiple number of throats (37, 38) offset with respect to the axial motion (9) of the bringer gripper (4) to offset the wefts (12) during insertion by coming to rest at the bottom of at least one of the multiple number of throats (37, 38) in the direction of axial motion (9), during the axial motion of the bringer gripper (4);

inserting the multiple wefts (12*a*, . . . 12*h*) into the bringer gripper (4) to come to rest at the bottom of the multiple throats (37, 38) in a manner offset in the direction (9) of the grippers (4, 50) whereby the wefts (12*a*, . . . 12*h*) are arranged to the multiple throats in the controlled sequence; and, presenting the wefts (12) to the taker gripper (50) in the order of the controlled sequence.

6. The method of presenting a plurality of wefts (12*a*, . . . 12*h*) in a controlled sequence from a bringer gripper (4) having axial motion (9) to a taker gripper (50) of a loom according to claim 18 and including the further step of:

varying the angle at which each of the wefts (12*a*, . . . 12*h*) is presented to the bringer gripper (4) with respect to the axial direction of motion (9) of the grippers (4, 50) to determine the controlled sequence in which the wefts (12*a*, . . . 12*h*) are arranged in the bringer gripper.

7. The method of presenting a plurality of wefts (12*a*, . . . 12*h*) in a controlled sequence from a bringer gripper (4) having axial motion (9) to a taker gripper (50) of a loom according to claim 19 and wherein the varying the angle at which each weft (12) is presented to the bringer gripper includes:

providing the bringer gripper (4) with throats (37, 38) so that the throat (37) placed closest to the gripping organ (25) is made of a lesser axial depth with respect to the throat (38) placed on the side of feeding reels so that the wefts (12) presented to the bringer gripper (4) at a tight angle are presented to the taker gripper (5) before those presented to the bringer gripper at a more open angle.

8. The method of presenting a plurality of wefts (12*a*, . . . 12*h*) in a controlled sequence from a bringer gripper (4) having axial motion (9) to a taker gripper (50) of a loom according to claim 19 and wherein the varying the angle at which each weft (12) is presented to the bringer gripper includes:

providing the bringer gripper (4) with throats (37, 38) so that the throat (37) placed closest to the gripping organ (25) is made of a greater axial depth with respect to the throat (38) placed on the side of feeding reels so that the wefts (12) presented to the bringer gripper (4) at an open angle are presented to the taker gripper (50) before those presented to the bringer gripper (4) at a tighter angle.

9. The method of presenting a plurality of wefts (12*a*, . . . 12*h*) in a controlled sequence from a bringer gripper (4) having axial motion (9) to a taker gripper (50) of a loom according to claim 19 including:

interposing in the path of the wefts a switch for modifying an angle of presentation of wefts (12) to the bringer gripper (4).

10. The method of presenting a plurality of wefts (12*a*, . . . 12*h*) in a controlled sequence from a bringer gripper (4) having axial motion (9) to a taker gripper (50) of a loom according to claim 22 wherein the interposing step includes:

mounting the switch to a platelet (60) fitted with a projection (61) having a rising profile on which the weft yarn (12) is deflected; and, linking the platelet to a stationary structure (62) of the machine, by a linkage adjustable in the direction of the axial motion (9) of the gripper.

11. The method of presenting a plurality of wefts (12*a*, . . . 12*h*) in a controlled sequence from a bringer gripper (4) having axial motion (9) to a taker gripper (50) of a loom according to claim 22 wherein the interposing step includes:

providing the switch with an element (71) controlled to rise and fall to change the angle of presentation of at least one of the wefts (12*a*, . . . 12*h*) to the bringer gripper (4).

12. The method of presenting a plurality of wefts (12*a*, . . . 12*h*) in a controlled sequence from a bringer gripper (4) having axial motion (9) to a taker gripper (50) of a loom according to claim 24 and further including:

controlling the element (71) to rise or fall in coordination with the actuating of rods (11*a*, . . . 11*h*) which present the wefts (12*a*, . . . 12*h*) to be deflected.

13. The method of presenting a plurality of wefts (12*a*, . . . 12*h*) in a controlled sequence from a bringer gripper (4) having axial motion (9) to a taker gripper (50) of a loom according to claim 18 and including the further step of:

varying the angle at which each of the wefts (12*a*, . . . 12*h*) is presented to the bringer gripper (4) to reduce the length of the uncontrolled stretch in the direction of the fabric (1).

* * * * *